US008640405B2

(12) United States Patent
Metzidakis

(10) Patent No.: US 8,640,405 B2
(45) Date of Patent: Feb. 4, 2014

(54) TEMPORARY RAILING SYSTEM

(76) Inventor: Philip Avedis Metzidakis, Nyack, NY (US)

( * ) Notice: Subject to any disclaimer, the term of this patent is extended or adjusted under 35 U.S.C. 154(b) by 855 days.

(21) Appl. No.: 12/849,792

(22) Filed: Aug. 3, 2010

(65) Prior Publication Data

US 2012/0032129 A1 Feb. 9, 2012

(51) Int. Cl.
*E04F 11/00* (2006.01)

(52) U.S. Cl.
USPC ..... 52/184; 52/832

(58) Field of Classification Search
USPC ..... 52/184, 832, 833, 191; 256/59, 65.16
See application file for complete search history.

(56) References Cited

U.S. PATENT DOCUMENTS

| | | | | | |
|---|---|---|---|---|---|
| 990,267 | A * | 4/1911 | Hill | 52/184 |
| RE33,975 | E * | 6/1992 | Asplund et al. | 29/464 |
| 5,551,194 | A * | 9/1996 | Toomey | 52/184 |
| 5,853,166 | A * | 12/1998 | Koza | 256/59 |
| 6,609,703 | B1 * | 8/2003 | D'Arcy | 256/59 |
| 7,032,355 | B1 * | 4/2006 | Gyure et al. | 52/184 |

* cited by examiner

*Primary Examiner* — Basil Katcheves

(57) ABSTRACT

A temporary railing system includes interior and exterior plates, temporary railing portions, and support arms designed to connect to the plates and support the temporary railing portions. The interior and exterior plates are designed in such a way that they are able to be installed on preexisting balusters by being placed snuggly against the balusters and bolted to each other with connecting bolts. The support arm is held into place by the two plates and is able to support the temporary railing portions. Multiple interior and exterior plate pairs can be used in a single installation to support multiple portions of temporary railing. The temporary railing portions are designed to fit seamlessly together, if desired, during installation.

15 Claims, 6 Drawing Sheets

TEMPORARY RAILING SYSTEM

CROSS REFERENCE TO RELATED APPLICATIONS

The present application does not claim the benefit of any U.S. Provisional or Non-provisional Applications.

FIELD OF THE INVENTION

The field of the present invention generally relates to railings for stairs, rooms, and walkways inside and outside of buildings.

BACKGROUND OF THE INVENTION

Many railing installations in or around a building are designed to be permanent. They are designed to last as long as the building or grounds themselves. Even when alterations are made to the original structure or grounds, these alterations are designed to be permanent as well. In the past, permanent changes were the most effective and cost efficient ways of altering a building or grounds. Carpentry and contracting work is expensive and is not undertaken unless the resulting work is meant to persist for an extended period of time. Many people enjoy performing carpentry and other building or construction repairs and updates themselves but projects of this nature tend to be time consuming as well as expensive.

The expensive and time consuming nature of updating a building or grounds means that installing safe and reliable temporary updates are impractical. This is true of providing safety railing in homes where children are resident. Children, because of their diminutive stature, have difficulty using an existing railing that is designed for adults. Because of this, they may have to navigate stairs or walkways without the benefit of using a railing at all. Providing another permanent, supplementary railing expressly for the use of children is not an optimal solution because as the children grow, they will cease using the temporary railing and it will become superfluous. Furthermore, temporary railings may also improve the safety of passages and stairwells for the elderly and people with disabilities.

It would be beneficial to have a system and apparatus for providing a temporary railing in a stairway or in a passageway. It would be beneficial to have a temporary railing system that has easily adjustable supports that allow for the railing system to be fitted to a variety of stairwells and passageways. Furthermore, it would be beneficial to have a temporary railing system and apparatus that can be adjusted and refitted to meet the needs of the users as the needs of the users change, such as when a child grows up. Moreover, it would be beneficial to provide the temporary railing system as a self-contained kit that can be easily installed and removed by a layperson.

SUMMARY OF THE INVENTION

This summary is provided to introduce (in a simplified form) a selection of concepts that are further described below in the Detailed Description. This summary is not intended to identify key features of the claimed subject matter, nor is it intended to be used as an aid in determining the scope of the claimed subject matter.

In overcoming the above disadvantages associated with permanent railings in and around buildings for stairways and passageways, the present invention discloses a temporary railing apparatus and system that can easily be installed to existing structures. The present invention includes interior and exterior plates that can be bolted together and secured around existing balusters. These plates together support a support arm. One or more of these plates couples are to be secured in a stairwell or passageway with each couple supporting a support arm. Temporary railing sections are affixed to the tips of the support arms. These railing sections provide the hand rail for the temporary rail apparatus and system.

The present invention discloses an apparatus including interior plates, exterior plates, railing support arms, and railing portions. The interior plates are positioned on the interior of pre-existing balusters and connected to the exterior plates positioned on the exterior of the balusters with connecting bolts secured in holes on the interior and exterior plates. The support arms are affixed to the plates and support the railing portions that extend between the support arms.

In accordance with another aspect of the invention, the interior plates have holes in the center of the plates and the exterior plates have grooves in the center of the plates. Each railing support arm is affixed to an interior plate and an exterior plate by being placed through the hole in the interior plate and fitted in position by the groove in the center of the exterior plate.

In accordance with another aspect of the invention, the holes in the interior plates and the exterior plates for the connecting bolts are positioned on the perimeter of the interior plates and on the perimeter of the exterior plates.

In accordance with another aspect of the invention, the support arms are tipped with connectors that connect the railing portions to the support arms and which hold the railing portions in place.

In accordance with another aspect of the invention, the support arms are made of plastic.

In accordance with another aspect of the invention, the interior plates and the exterior plates are fitted with cushions positioned on the faces of the interior plates and the exterior plates facing the balusters.

In accordance with another aspect of the invention, a temporary railing system includes interior plates, exterior plates, railing support arms, and railing portions. The interior plates are positioned on the interior of pre-existing balusters and connected to the exterior plates positioned on the exterior of the balusters with connecting bolts secured in holes on the interior and exterior plates. The support arms are affixed to the plates and support the railing portions that extend between the support arms.

In accordance with another aspect of the invention, a temporary railing system to be installed on the balusters of an existing rail system includes interior plates, exterior plates, railing support arms, and railing portions.

In accordance with another aspect of the invention, the interior plates are positioned on the interior of the balusters of the existing railing system and connected to the exterior plates positioned on the exterior of the balusters of the existing railing system with connecting bolts secured in holes on the interior and exterior plates. The support arms are affixed to the plates and support the railing portions that extend between the support arms.

BRIEF DESCRIPTION OF THE DRAWINGS

Preferred and alternative examples of the present invention are described in detail below with reference to the following Figure drawings.

DETAILED DESCRIPTION

Figure 1:
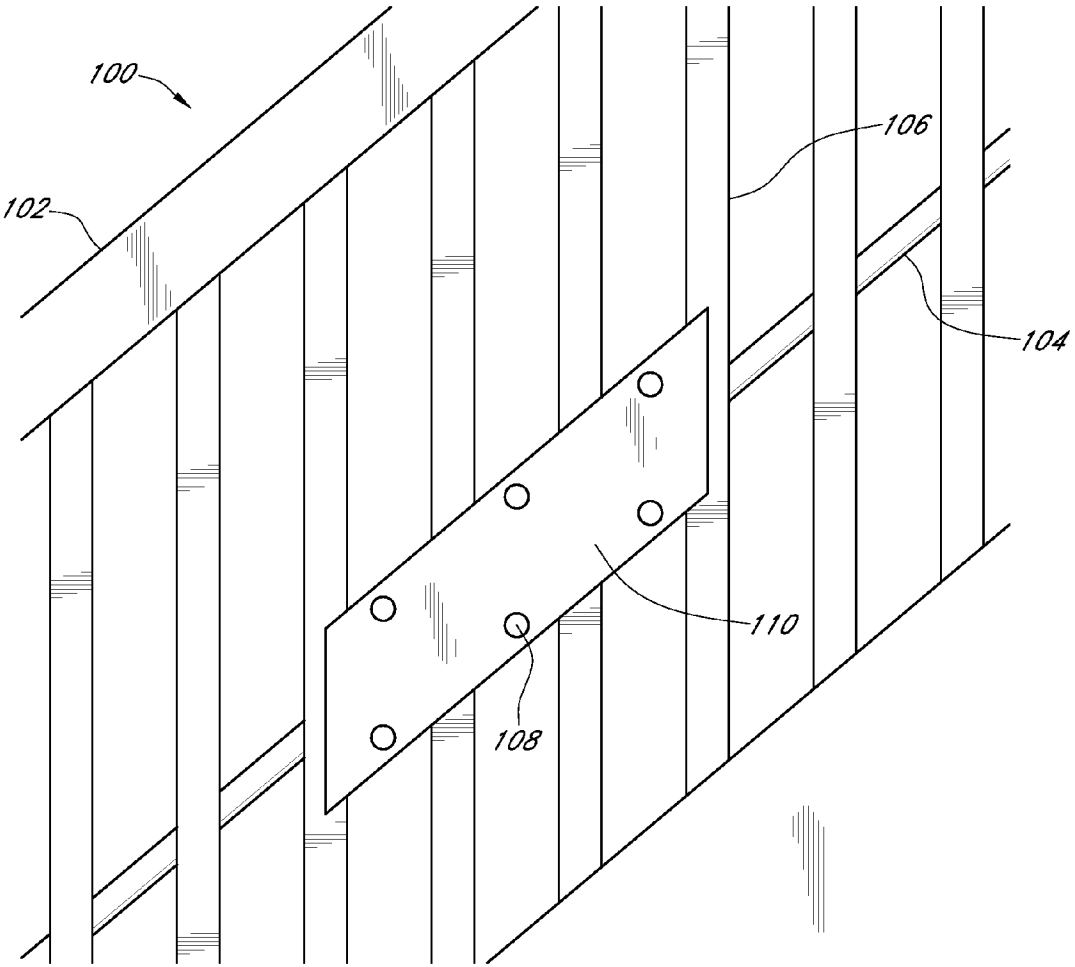
FIG. 1 illustrates a view of the exterior plate attached to preexisting balusters in accordance with embodiments of the present invention.

In accordance with an exemplary embodiment of the present invention, FIG. 1 illustrates a view of the temporary railing system 100. An existing railing 102 is supported by balusters. A baluster 106 may be any shape or size. They may be made of wood, metal, plastic or any other material commonly used in construction. They may be painted and they may also have some type of finish. The exterior plate 110 of the present invention is secured around the preexisting balusters by being connected to an interior plate (not shown) by bolts. A bolt 108 is used to secure the two plates to one another. The plates may be made of wood, plastic, metal, or any other material commonly used in construction. The exterior plate 108 and the interior plate (not shown) together hold up the temporary railing 104. The temporary railing can be made of wood, plastic, metal, or any other material commonly used in construction. In an embodiment of the present invention, the temporary railing is not a single piece. The temporary railing may be constructed from several different pieces of railing. In an embodiment of the present invention, the pieces of temporary railing are designed to be able to connect directly to one another.

Figure 2:
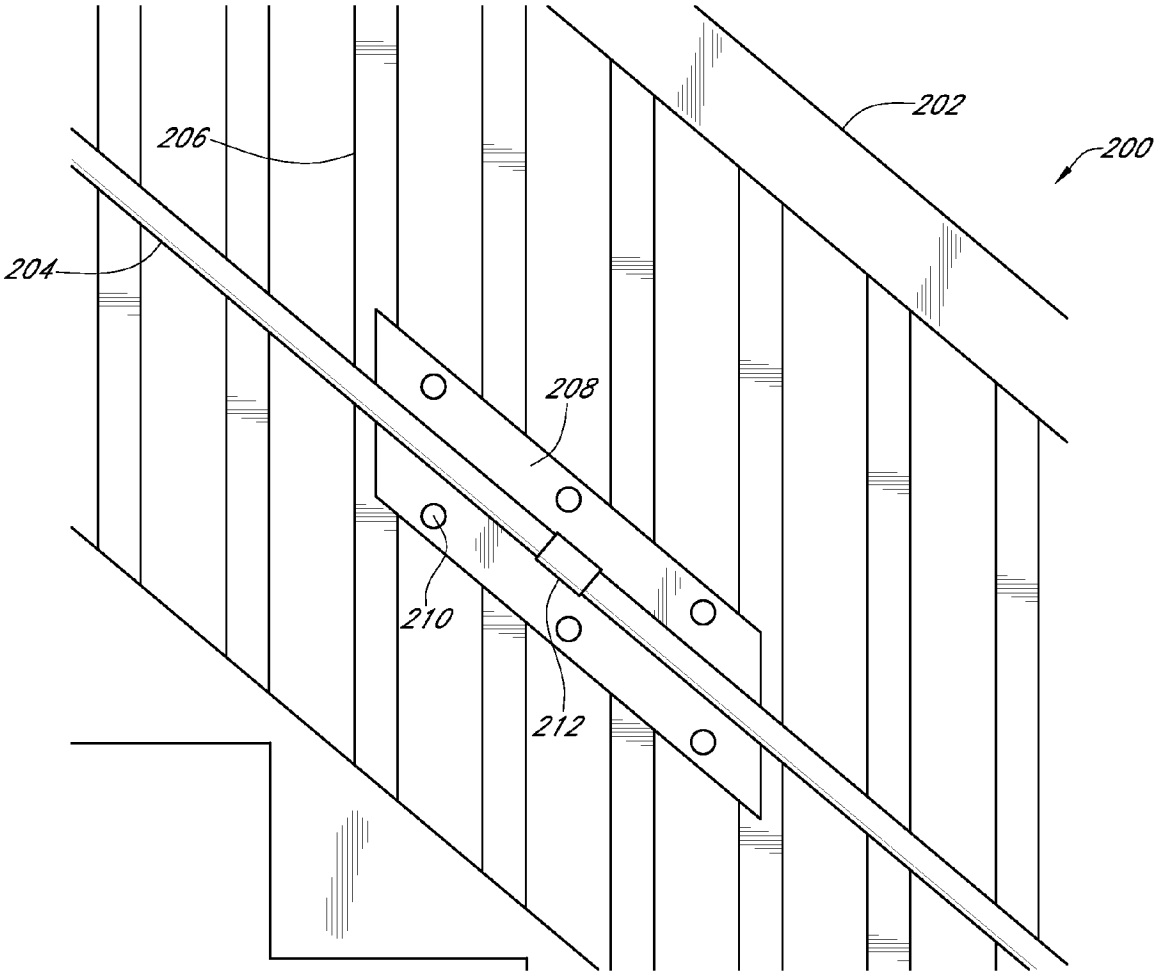
FIG. 2 illustrates a view of the interior plate attached to preexisting balusters as well as the railing in accordance with embodiments of the present invention.

FIG. 2 shows an interior view of the temporary railing system 200. The existing railing 202 is supported by balusters such as baluster 206. The interior plate 208 is secured around the preexisting balusters by being connected to an exterior plate (not shown) by bolts. A bolt 210 used to secure the two plates to one another. The plates may be made of wood, plastic, metal, or any other material commonly used in construction. The interior plate 208 and the exterior plate (not shown) together hold up the temporary railing 204. The temporary railing is connected to the interior plate 208 and the exterior plate (not shown) by a support arm 212.

In an embodiment of the present invention, the support arm 212 is made of a plastic such as molded, high-impact plastic. Alternatively, the support arm 212 may be made of wood or metal or any other material used in construction. Furthermore, the support arm 212 may be made of any combination of materials previously listed or used in construction. In an embodiment of the present invention, the support arm 212 is designed as a plastic pipe cut square on the end that nests in the external plate and has a semicircular cut on the other end to mate with the hand rail. Additionally, there may be a semi-circular notch at the low point of the semi-circular cut to accommodate a tensioning bolt. In an embodiment of the present invention, the temporary railing 204 includes a big notch for the hand rail, and a second notch, 90 degrees opposed, for the tensioning bolt. In an embodiment of the present invention, the tensioning bolt may be a quarter inch (¼") or five sixteenths (5/16") eye bolt that slips over the temporary railing 204 with tight clearance. In an embodiment of the present invention, the eyebolt goes over the handrail and through the support arm. When tightened, the bolt pulls the temporary railing 210 tight to the support arm 212. The support arm, which passes through the interior gusset and nests in the exterior gusset, is solidly mounted.

In an embodiment of the present invention, the support arm 212 is made of a plastic such as molded, high-impact plastic. Alternatively, the support arm 212 may be made of wood or metal or any other material used in construction. Furthermore, the support arm 212 may be made of any combination of materials previously listed or used in construction. In an embodiment of the present invention, the support arm 212 is designed as a plastic pipe cut square on both ends. One end nests in the external plate, the other end receives a tee fitting similar to tee-fittings used in plumbing. The end that nests into the exterior plate has a nylock nut recessed into the pipe at sufficient depth to allow the end of the pipe to seat in the groove of the exterior plate. The arms of the tee form a continuous hole that allows the railing portion to pass through. The three arms of the tee have set screws to secure the tee fitting to the railings and support arms. In an embodiment of the present invention, a quarter inch (¼") bolt backed by a fender washer passes through the exterior plate and connect to the recessed nut in the support arm, creating a solid connection. The support arm, which passes through the interior gusset and nests in the exterior gusset, is solidly mounted.

In an embodiment of the invention, the support arm passes through the interior plate and connects to the outside plate. The internal plate may have a hole near the center to allow the support arm to pass through with relatively tight clearance, for example, one thirty-second of an inch (1/32"). The exterior plate may have a hole near the center of the plate surrounded by a groove. The arm is made of plastic tubing and has a nut permanently affixed inside the tube and recessed the depth of the groove plus a small clearance on the order of an eighth of an inch (⅛"). The support arm passes through the interior plate. The support arm nests or seats in the groove on the exterior plate and a bolt passes through the hole in the exterior plate and connects to the nut, such as a nylock nut, in the support arm. Alternatively, the bolt may pass through a flat washer such as a lock washer, through the hole and connects to a recessed standard nut. In an embodiment of the present invention, the internal plate has a hole near the center to allow the support arm to pass through with relatively tight clearance, for example, one thirty-second of an inch (1/32"). The support arm has a bolt extending from it so that the support arm seats in the groove and the bolt passes through the center hole and receives a nylock or standard nut with a flat washer and lock washer. In an embodiment of the present invention, the bolt may a quarter inch (¼") or five sixteenths of an inch (5/16"). The internal plate has a hole near the center to allow the support arm to pass through with relatively tight clearance, for example one thirty-second of an inch (1/32"). The support arm may be made of a metal, such as cast aluminum, and may terminate in a threaded end so that it can be screwed directly into a threaded hole in the exterior plate. In an alternative embodiment, the support arm may be made of wood and terminate in threaded metal fitting. The threading the exterior plate may be done in a variety of ways: tapping the material of the plate or having a tapped insert styled on a tee-nut. In an embodiment of the present invention, the tee-nut has square shoulders, like a carriage bolt.

The support arm may be attached to the railing in a variety of ways. In an embodiment of the present invention, the support arms are shipped long so that they may be cut to accommodate different baluster widths. A tee fitting with set screws at all three openings attaches the support arm to the railing. The base of the tee fits over the support arm and is attached by set screws, wood screws, through screws, or any other screw commonly used in construction. The top of the tee allows the railing to pass all the way through the tee. The tee may have set screws to secure the railing to the tee and prevent the railing from spinning. The base of the tee fitting may be glued to the support arm.

In an embodiment of the present invention, the support arm has two parts. One side is threaded and screwed, without the use of any tools, into the external plate. The other end has a molded-on tee with set screws. The side with the tee slips over the side with the threaded end to allow adjustment of the length of the support arm without the need for tools. The side with the tee has set screws to connect the support arm solidly. In an embodiment of the present invention, the side that threads into the plate is made of high impact plastic. The threads at the end terminate in a shoulder so that the support arm mates securely to the exterior plate. The reaming length of the support arm is threaded. The interior of the support arm that has the molded-on tee is threaded internally. The two support arms are threaded together to adjust for needed length. Once the railing is through the tee, the support arm cannot unscrew. In an embodiment of the present invention, the final one and a half inches (1.5") of the externally threaded support arm is a contrasting color. The instructions included with the support arm would be explicit that the entire length of the colored thread must not be visible on final installation.

Figure 3:
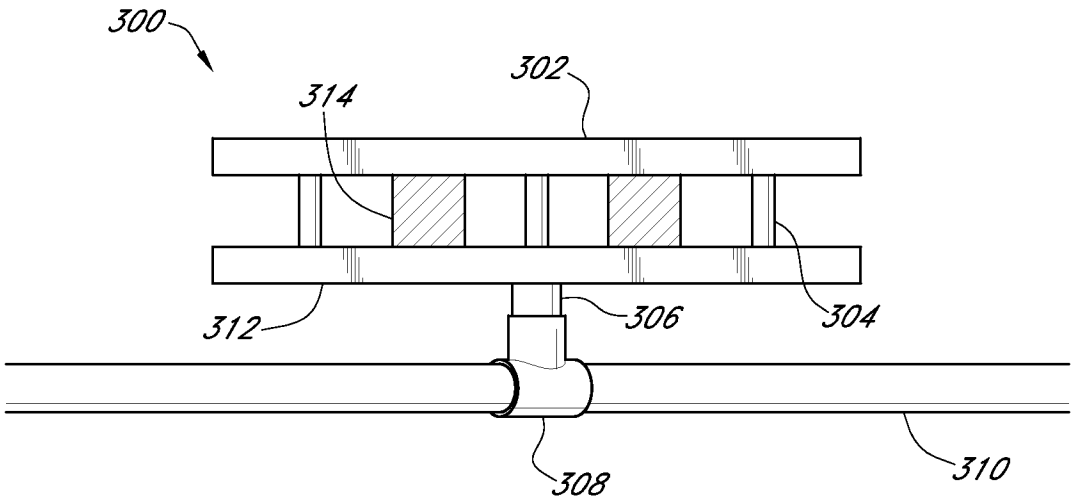
FIG. 3 illustrates a top-down cut-away view of the apparatus and system in accordance with embodiments of the present invention.

FIG. 3 shows a top-down, cut-away view of the temporary railing system 300 as it is affixed to preexisting balusters in accordance with an embodiment of the present invention. The exterior plate 302 is connected to the interior plate 312 via connecting bolts such as 304. The connecting bolts are tightened to hold the interior plate 312 and the exterior plate 302 snug with the balusters such as baluster 314 so that the two plates can support the support arm 306, support arm connector 308, and temporary railing 310. The support arm 306 extends through a hole (not shown) in the interior plate 312 and is fitted into place against the exterior plate 302. The interior plate 312 and the exterior plate 302 together hold the support arm 306 in place. The support arm connector 308 is affixed to the end of the support arm 306 and provides an interconnection between the support arm 306 and the temporary railing 310. In an embodiment of the present invention, the support arm 306 and the support arm connector 308 are separate pieces that are connected to each other during installation. Alternatively, the support arm 306 and the support arm connector 308 may be a single piece in the present invention.

In an embodiment of the present invention, the interior plate 312 and exterior plate 314 are gussets plates. In an embodiment of the present invention, the interior plate 312 and exterior plate 302 have a series of holes for bolting them to the opposite sides of the balusters. To eliminate the possibility that young children or other users of the temporary railing putting their fingers in the unused holes, tripping on the stairs, and breaking a finger, hole plugs are fitted into any unused bolt holes on the plates. In an embodiment of the present invention where the plates are plastic, the plates are designed with knock-out plugs. Only the hole plugs in the bolt holes are knocked out during installation to make room for the connecting bolts. If the plates are constructed out of wood, the hole plugs are threaded in such a way as to fit in the unused bolt holes.

One of the advantages of the invention to be able to be installed on balusters of varying, different shapes and sizes. In an embodiment of the present invention, to allow for easy installation for any size balusters, the connecting bolt is a tensioning bolt that has a long nut permanently attached to it, thus reducing the both the complication of a bolt getting loose with use and the need for different length bolts. The other end of the long nut may be standard with a star lock washer employed under the nut on the tensioning bolt on the external plate.

In another embodiment of the present invention, there is a long nut that has a nylock end. This embodiment of the bolt and nut works like a turnbuckle: two bolts and a cradle with left and right threads. In this embodiment one end of the cradle is permanently attached to the tensioning bolt. The other end has a nylock nut. Thus adjustment for width of the baluster would be accounted for with a long bolt and the long travel distance afforded by the cradle.

The bolts that hold the plates to each other may be many styles. In an embodiment of the present invention, a bolt with a clean finish may be used to obviate the chance of clothing or flesh catching on a protruding bolt. In an embodiment of the present invention, connecting bolts with Allen heads are used. In an embodiment of the present invention, the connecting bolts have over-length female threading.

In an embodiment of the present invention, cushions fitting the plates will be included to prevent the balusters from being marred by the temporary railing system. These cushions may be designed to have a peel-and-stick side that allows for easy application to either of the plates. These cushions may be made from neoprene or any other material that would not mar the finish of the balusters. In an embodiment of the present invention, these cushions are the same shape as the gussets and have holes that line-up with the holes on the plates. In an alternative embodiment of the present invention, the cushions are designed to only cover those portions of the interior and exterior plates that directly touch the balusters. The holes in the cushions may be oversized to accommodate sloppy installation and manufacturing irregularities. The cushions included in the present invention may be of varying thickness. One set of cushions may be three sixty-fourths of an inch (3/64") or one sixteenth of an inch (1/16") thick while another set of cushions may have varying thicknesses. A set of cushions may include a one sixteenth of an inch (1/16) or thinner cushion as well as a cushion about three eighths of a inch (3/8") thick. The plates may be installed without the cushions or with thin cushions if the balusters are simple square stock. The thicker cushions may be used to effect a more positive grip on the balusters if the balusters are round or tapered or round and tapered.

Figure 4:
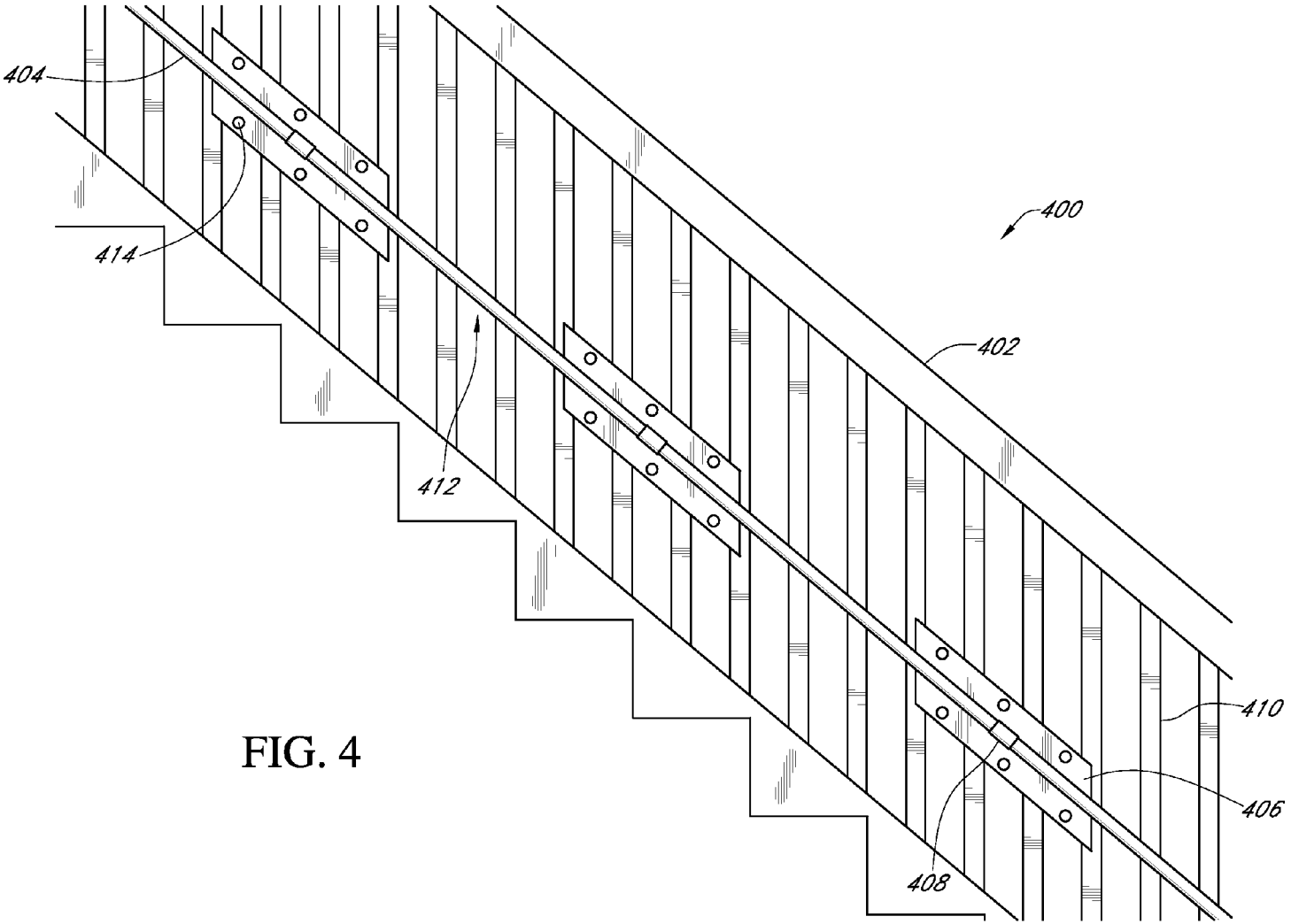
FIG. 4 illustrates the temporary railing system attached with multiple interior plates to preexisting balusters.

FIG. 4 illustrates a wider view of the temporary railing system 400 of the present invention. In the present embodiment, a preexisting railing includes balusters such as baluster 410 and permanent railing 402. The temporary railing system 400 is attached to the balusters of the preexisting railing system by the interior plates 406 coupled to the exterior plates (not shown) by connecting bolts such as 414 as previously disclosed. The temporary railing 404 is supported by the support arm connector 408 which connects it to the interior plate 406 via the support arm (not shown). In the present embodiment, the temporary railing 404 is comprised of several pieces or railing connected to each other. As discussed below, the temporary railing 404 may be made of wood, plastic, or any other material used in construction or any combination thereof. The temporary railing 404 may include pieces of temporary railing such as 412. The temporary railing 404 may be cylindrical or it may be rectangular or it may be square in cross-section. The temporary railing 404 may also be finished in such a way that it provides for extra grip. Furthermore, the temporary railing 404 may be capped at its ends. This capping may be purely decorative or it may smooth the edges of the temporary railing 404.

In FIG. 4, three interior plates are shown. The invention is by no means limited to this configuration. Embodiments of the present invention may include as few as one interior plate (and a corresponding exterior plate). There is no upper bound for how many interior plates (and corresponding exterior plates) may be used in an embodiment of the present invention. This is also true for the temporary railing. In an embodiment of the present invention, only a short length of temporary railing may be installed (enough to form a hand grip). There is no upper bound for the length of temporary railing used in an embodiment of the present invention. Furthermore, the temporary railing may also be discontinuous. Moreover, several temporary railings of the present invention may be installed at the same time on the same preexisting balusters, to accommodate different users such as children of different heights. In FIG. 4, the interior plates are aligned with each other. The present invention is by no means limited to this embodiment. The interior plates (and the corresponding exterior plates) may be placed on the balusters in any way that aids in the placement of the temporary railing for optimal use. The accompanying support arms and support arm connectors may be positioned also in such a way that allows for the placement of the temporary railing for optimal use.

Figure 5:
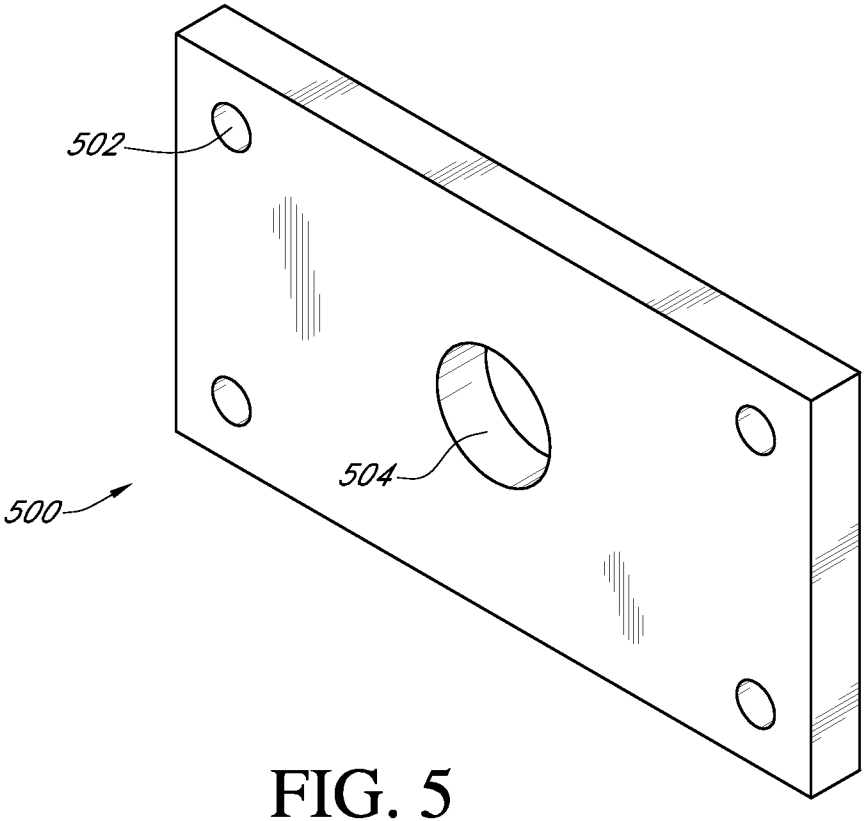
FIG. 5 illustrates a view of the interior plate in accordance with embodiments of the present invention.

FIG. 5 illustrates a view of the interior plate 500 in an embodiment of the present invention. The interior plate 500 has center hole 504 in the middle of the plate for the support arm to pass. The interior plate will have bolt holes, of which 502 is one, for the bolts. In an embodiment of the present invention, the center hole 504 is about an inch (1") in diameter. The center hole 504 shown in FIG. 5 is circular. The present invention is by no means limited to this embodiment. The center hole may be square or some other shape. Furthermore, it may have a diameter greater or lesser than one inch (1"). In an embodiment of the present invention, the center hole is designed so that the support arm is able to fit snuggly through it and the center hole is able to hold the support arm steady, even when significant force is exerted upon it by the temporary railing. The interior plate may also have any number of bolt holes. In an embodiment of the present invention, the interior plate has six bolt holes. In the FIG. 5, the bolt holes are placed towards the periphery of the interior plate. The present invention is by no means limited to this embodiment. The bolt holes may be placed anywhere on the face of the interior plate. In an embodiment of the present inventions, the bolt holes are placed in such a way that the connecting bolts are easily aligned between the bolt holes on the interior plate and the bolt holes on the exterior plate (discussed later) and in such a way as to avoid contact with the balusters or any other preexisting fixture. The interior plate may also have additional bolt holes that are unused. The sides of the bolt holes may be threaded or they may be smooth.

In an embodiment of the present invention, the support arm and the interior plate may be one single piece. In this embodiment the support arm extends out of the interior plate. In another embodiment of the present invention, the support arm and the interior may be two distinct pieces but the interior piece may not pass through the interior plate. Instead, the interior plate has a connector portion on its face not facing the baluster that accepts the support arm and holds it in place. In an embodiment of the present invention, the support arm may be able to snap into the interior plate connector portion. In an alternative embodiment, the support connector portion may be a groove or a hole that can accept the threaded portion of a support arm. During installation, the support arm is screwed into the connector portion of the interior gusset plate and held into place. In an alternative embodiment, the support arm passes through the interior gusset plate and thread directly to the exterior plate either by having the exterior plate tapped or by having a threaded connector attached to the exterior gusset plate.

Figure 6:
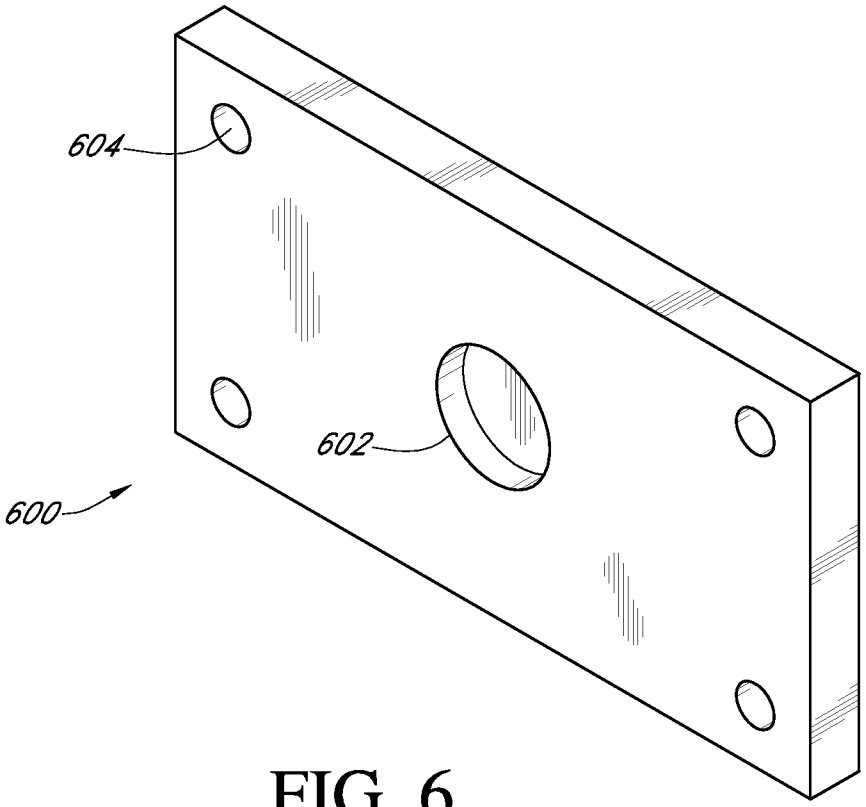
FIG. 6 illustrates a view of the exterior plate in accordance with embodiments of the present invention.

FIG. 6 illustrates a view of the face facing the balusters of the exterior plate 600 in an embodiment of the present invention. The interior plate 600 has support arm groove 602 in the middle of the plate to hold the support arm in place. The interior plate will have bolt holes, of which 604 is one, for the connecting bolts. The support arm groove 602 shown in FIG. 6 is circular. The present invention is by no means limited to this embodiment. The support arm groove may be square or some other shape. Furthermore, it may have a diameter greater or lesser than one inch (1"). In an embodiment of the present invention, the support arm groove is designed so that the support arm is able to fit snuggly into it and the support arm groove is able to hold the support arm steady, even when significant force is exerted upon it by the temporary railing. In another embodiment of the present invention, the face of the exterior plate facing the baluster may not include a support arm groove. Instead, the support arm may fit snuggly against the exterior plate or may not touch the exterior plate directly at all. Furthermore, the support groove may be designed in such as way as to allow a threaded portion of a support arm to be screwed into place. In an embodiment of the present invention, the support arm groove 602 has a center hole, one quarter of an inch (¼") or five sixteenths of an inch (5/16"), surrounded by the rounded groove around the hole. The exterior plate may also have any number of bolt holes. In an embodiment of the present invention, the exterior plate has six bolt holes. In the FIG. 6, the bolt holes are placed towards the periphery of the exterior plate. The present invention is by no means limited to this embodiment. In an embodiment of the present invention, there is a through-hole in the center of the circular groove to accommodate the support arm tensioning bolt. The bolt holes may be placed anywhere on the face of the exterior plate. In an embodiment of the present inventions, the bolt holes are placed in such a way that the connecting bolts are easily aligned between the bolt holes on the interior plate (previously discussed) and the bolt holes on the exterior plate and in such a way as to avoid contact with the balusters or any other preexisting fixture. The exterior plate may also have additional bolt holes that are unused. The sides of the bolt holes may be threaded or they may be smooth.

In an embodiment of the present invention, the components of the invention are designed to be part of a kit for do-it-yourself installation by the owners or inhabitants of premises where the invention will be installed. The kit includes one or more interior plates, exterior plates, railing support arms, and pieces of temporary railing. The interior plates and exterior plates may be designed with a variety of parameters. The thickness may be between three quarters of an inch (¾") and one and one quarter of and inch (1 and ¼"), approximately. The length and height of the plates may also be about three inches (3") wide and eleven inches (11") long. Alternatively the plates could be round, oval, parallelograms, rectangles with the short ends rounded, or another shape for either practical or decorative. In an embodiment of the present invention, the interior and exterior plates are both rectangular. In other embodiments, the plates may be oval or square or some other geometric shape. The interior and exterior plates do not need to be the same size and shape as each other. The temporary hand railing may be seven eighths of an inch (⅞") hardwood dowel in about thirty inch (30") lengths. The ends may be threaded much like that of a mop handle. The thread length is on the order of one and one quarter inches (1.25"). The outer diameter of the threads may be about five eighths of an inch (⅝") or a little less so that there is a shoulder where the smooth dowel ends and the threads begin. The kit may also include ferrules that are threaded on each end to receive the threaded dowels. The thickness of the walls of the ferrules may be about one eighths of an inch (⅛") such that the outside of the ferrule is flush with the surface of the dowel insuring that the entire hand rail once assembled and installed has no bumps. During the installation of the temporary railing, as many or as few dowels as needed are threaded together and any excess length at either the beginning of the railing or at the end is sawed off. A piece of sand paper may also be included in the kit to smooth-away splinters. The kit may also include one or more peel-and-stick cushions for affixing to the interior and exterior plates. The support arm may be a single piece in the kit or may be dissembled into two or more pieces. In an embodiment of the present invention, the support arm may come in two components: the support arm itself and the support arm connector. The kit may include supports arms of different types and sizes. Furthermore, different kits may include different size support arms. The kits may also include additional materials to aide in the assembly and installation of the temporary railing system. The kits may include certain tools such as Allen wrenches to aid in the installation of the temporary railing system. The kit may also include paints or stain for the various components of the temporary railing system. The components of the temporary railing system of the present invention may also be pre-painted or pre-decorated. In an embodiment of the invention, the exterior and interior plates as well as the support arm and the temporary railing may have a finish that matches popular finishes used in homes and office and commercial buildings. In another embodiment of the present invention, the finish may be brightly colored or decorated with characters or images in such a way that it would appeal to children.

While several embodiments of the present invention have been illustrated and described herein, many changes can be made without departing from the spirit and scope of the invention. Accordingly, the scope of the invention is not limited by any disclosed embodiment. Instead, the scope of the invention should be determined from the appended claims that follow.

The embodiments of the invention in which an exclusive property or privilege is claimed are defined as follows:

1. A apparatus comprising:
interior plates;
exterior plates;
railing support arms;
and railing portions;
wherein the interior plates are positioned on the interior of pre-existing balusters and connected to the exterior plates positioned on the exterior of the balusters with connecting bolts secured in holes on the interior and exterior plates;
wherein the support arms are affixed to the plates and support the railing portions that extend between the support arms;
wherein the interior plates have holes in the center of the plates and the exterior plates have grooves in the center of the plates; and
wherein each railing support arm is affixed to an interior plate and an exterior plate by being placed through the hole in the interior plate and fitted in position by the groove in the center of the exterior plate.

2. The apparatus of claim 1, wherein the holes in the interior plates and the exterior plates for the connecting bolts are positioned on the perimeter of the interior plates and on the perimeter of the exterior plates.

3. The apparatus of claim 1, wherein the support arms are tipped with connectors that connect the railing portions to the support arms and which hold the railing portions in place.

4. The apparatus of claim 1, wherein the support arms are made of plastic.

5. The apparatus of claim 1, wherein the interior plates and the exterior plates are fitted with cushions positioned on the faces of the interior plates and the exterior plates facing the balusters.

6. A temporary railing system comprising:
interior plates;
exterior plates;
railing support arms;
and railing portions;
wherein the interior plates are positioned on the interior of pre-existing balusters and connected to the exterior plates positioned on the exterior of the balusters with connecting bolts secured in holes on the interior and exterior plates; and wherein the support arms are affixed to the plates and support the railing portions that extend between the support arms;
wherein the interior plates have holes in the center of the plates and the exterior plates have grooves in the center of the plates; and
wherein each railing support arm is affixed to an interior plate and an exterior plate by being placed through the hole in the interior plate and fitted in position by the groove in the center of the exterior plate.

7. The temporary railing system of claim 6, wherein the holes in the interior plates and the exterior plates for the connecting bolts are positioned on the perimeter of the interior plates and on the perimeter of the exterior plates.

8. The temporary railing system of claim 6, wherein the support arms are tipped with connectors that connect the railing portions to the support arms and which hold the railing portions in place.

9. The temporary railing system of claim 6, wherein the support arms are made of plastic.

10. The temporary railing system of claim 6, wherein the interior plates and the exterior plates are fitted with cushions positioned on the faces of the interior plates and the exterior plates facing the balusters.

11. A temporary railing system to be installed on the balusters of an existing rail system comprising:
interior plates;
exterior plates;
railing support arms;
railing portions;
wherein the interior plates are positioned on the interior of the balusters of the existing railing system and connected to the exterior plates positioned on the exterior of the balusters of the existing railing system with connecting bolts secured in holes on the interior and exterior plates; and wherein the support arms are affixed to the plates and support the railing portions that extend between the support arms;
wherein the interior plates have holes in the center of the plates and the exterior plates have grooves in the center of the plates; and
wherein each railing support arm is affixed to an interior plate and an exterior plate by being placed through the hole in the interior plate and fitted in position by the groove in the center of the exterior plate.

12. The temporary railing system of claim 11, wherein the holes in the interior plates and the exterior plates for the connecting bolts are positioned on the perimeter of the interior plates and on the perimeter of the exterior plates.

13. The temporary railing system of claim 11, wherein the support arms are tipped with connectors that connect the railing portions to the support arms and which hold railing portions in place.

14. The temporary railing system of claim 11, wherein the support arms are made of plastic.

15. The temporary railing system of claim 11, wherein the interior plates and the exterior plates are fitted with cushions positioned on the faces of the interior plates and the exterior plates facing the balusters.

* * * * *